United States Patent [19]

Mouttet

[11] 4,128,292

[45] Dec. 5, 1978

[54] RIGHT-ANGLE ELECTRIC CONTACT PLUG

[75] Inventor: Leon Mouttet, Lonay, Switzerland

[73] Assignee: Interlemo Holding, S.A. c/o Curia Treuchand A.G., Coire, Switzerland

[21] Appl. No.: 878,282

[22] Filed: Feb. 16, 1978

[30] Foreign Application Priority Data

Jul. 6, 1977 [CH] Switzerland ..... 8318/77

[51] Int. Cl.[2] ..... H01R 13/00

[52] U.S. Cl. ..... 339/176 R

[58] Field of Search ..... 339/103 R, 103 M, 176 R, 339/176 M

[56] References Cited

FOREIGN PATENT DOCUMENTS 902614 9/1945 France ..... 339/103 R

*Primary Examiner*—Gerald A. Dost

*Attorney, Agent, or Firm*—Anthony J. Casella

[57] ABSTRACT

A right-angle electric contact plug in which a right-angle body comprises a first tubular part comprising an end radial notch, a second tubular part debouching into the said notch, and a removable closure element fastened to at least one of the two parts of the body and intended to close off the notched end of the first part of said body. The plug is characterized by the fact that the two parts of the body are removable, that the two edges of the radial notch of the first part of the body form a slide, that the base of the second part of the body forms a slide, that the notched end of the first part of the body is threaded, and that the closure element is a threaded plug.

3 Claims, 4 Drawing Figures

RIGHT-ANGLE ELECTRIC CONTACT PLUG

The object of the present invention is a right-angle electric contact plug whose right-angle body comprises a first tubular part having at least one removable electric contact element and an end radial notch, a second tubular part debouching into the radial notch of the first part and having a clamping gripper intended to hold an electric connecting conductor, and a removable closure element fastened on at least one of the two parts of the right-angle body and intended to close off the notched end of the first part of said right-angle body after the connecting of the electric conductor to the electric contact element upon the assembling of said right-angle plug.

There is already known a right-angle plug of this type in which the second tubular part of the right-angle body, which is substantially perpendicular to its first part, also comprises a radial notch which coincides with that of the first part so as completely to free the rear of the plug and thus permit the simultaneous introduction of the electric contact element and of the electric conductor into the right-angle body after they have been previously connected, effected for instance by welding the bared wire of the conductor into the rear splayed portion of the contact element. This right-angle plug has a closure element in the form of a strip bent to form an angle, one arm of which, pierced with a central hole, is engaged around the second tubular part of the right-angle body and clamped against its base by means of a threaded clamping ring in engagement with an end thread of said second part, while the other arm, which is solid, closes off the notched end of the first part of the right-angle body. This threaded clamping ring, which is longer than the threaded end of the second part of the right-angle body, both closes off the notch of said second part and permits the internal threading of the chuck of the clamping gripper.

This right-angle plug is satisfactory since it makes it possible to avoid the connecting in situ of the conductor with the electric contact element, which is always difficult if not impossible to effect in certain cases, for instance in multi-pin miniature plugs having a plurality of contact elements grouped in a relatively small space within the right-angle body of the plug.

However, this right-angle plug requires the use of a large number of parts for its production, some of which parts do not lend themselves to mass production by cutting, such as for instance the closure member having the shape of a strip bent to form an angle. Furthermore, the closing of the notched end of the first element of the right-angle body by said bent part does not assure very good tightness since the closure arm of the said bent part is not clamped against the open end of the first part of the right-angle body of the plug. Finally, the operation of connecting said plug to a connector is lengthy since, in addition to the connecting proper of the contact element to the said connector and the putting thereof in place in the right-angle body of the plug, it then requires the putting in place of the closure element and the locking thereof by means of the threaded ring on the second part of the right-angle body before it is possible to lock said conductor in said second part by means of the clamping gripper.

The right-angle electric contact plug in accordance with the invention which is directed at overcoming these drawbacks, is characterized by the fact that the two parts of its body are removable, by the fact that the two edges of the radial notch of the first part of the body are shaped as a slideway, by the fact that the base of the second part of the body is shaped as a slide, by the fact that the notched end of the first part of the body is threaded, and by the fact that the closure element of the said notched end is a threaded plug, so that after connection of the electric conductor with the electric contact element, said contact element is introduced into the first part of the body at the same time as the slide of the second part of the body is engaged in the slideway of the notch of the first part, and that finally the threaded closure plug is screwed and tightened on the threaded end of said first part, thus rigidly assembling the two parts of the right-angle body by blocking the slide of the second part against the bottom of the slideway of the notch of the first part.

The accompanying drawings show the differences between the known right-angle plug and the right-angle plug which forms the object of the invention and it shows by way of example one embodiment of the latter.

Figure 1:
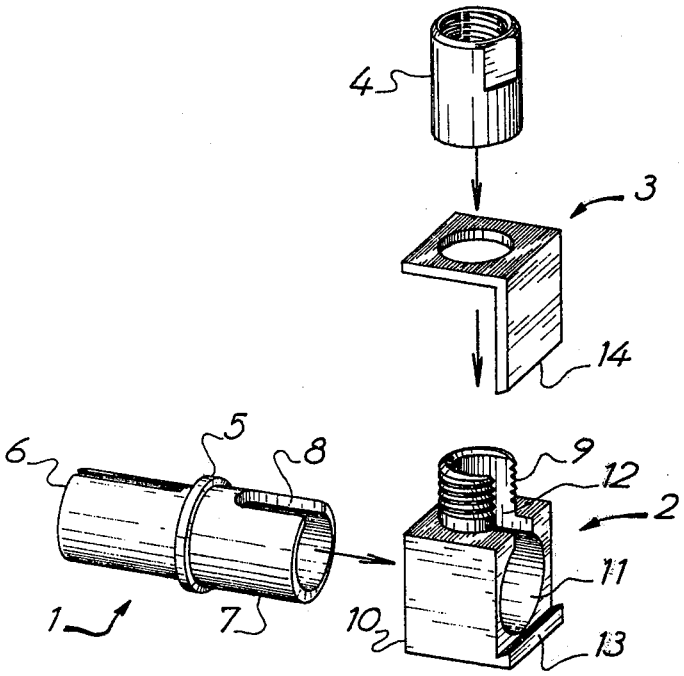
FIG. 1 is an exploded view of the known right-angle plug.

FIG. 1 shows the four parts constituting the outer structure of the aforementioned known right-angle plug; the two parts 1 and 2 of its right-angle body, the strip bent into an angle piece 3 forming its closure element, and its threaded locking ring 4.

The first part 1, which is tubular, is itself divided into two separate portions by a bearing collar 5, namely a left-hand portion 6 intended for plugging in a socket and a right-hand portion 7 having a radial notch 8.

The second part 2 of the right-angle body itself has an upper tubular portion 9 which is threaded and a lower parallelepiped portion 10 which is pierced by an axial hole 11. The tubular portion 9 has a radial notch 12 which enters into the axial hole 11 of the parallelepiped portion 10 and the front wall of the latter has a miter 13.

Upon the manufacture of this plug, these two parts 1 and 2 of the right-angle body are assembled, for instance by clamping or locking, in such a manner that the radial notch 12 of the second part 2 coincides with the radial notch 8 of the first part.

The vertical solid arm 14 of the angle-shaped closure element 3 has a splayed base which is intended to engage on the miter 13 of the lower portion of the second part 2 of the right-angle body, upon the blocking thereof on said lower portion by means of the threaded ring 4.

This known right-angle plug also has the customary internal elements, not shown, namely a chuck and a clamping gripper which fit themselves into the upper part of the threaded ring 4, above the threaded portion 9 of the second part 2 of the right-angle body, and at least one electric contact element which may be either a male pin or a female socket fitting in the left-hand portion 6 of the first part 1 of the right-angle body and which is partially surrounded by an insulation which fits and rests in the notched tubular portion 7 of said first part.

Figure 2:
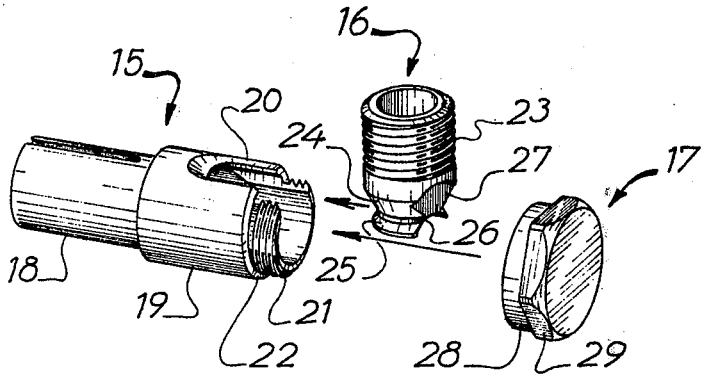
FIG. 2 is an exploded view of a right-angle plug in accordance with the invention.

Similar internal elements, not shown, namely chuck clamping gripper and electric contact element, are also provided for the right-angle plug in accordance with the invention, the parts constituting the outer structure of which are shown in FIG. 2.

These parts, only three in number, comprise the two tubular parts 15 and 16 of the right-angle body and an internally threaded plug 17 forming a closure element at the same time as a locking element for locking the assembly of the said two tubular parts 15 and 16. These two tubular parts 15 and 16 are in this case removable and not joined rigidly upon manufacture as in the case of the known right-angle plug described previously and shown in FIG. 1.

The tubular first part 15 of the right-angle body in this case also comprises a portion 18 which is intended to be plugged in a socket and a portion 19 having a radial notch 20, but the edges of this radial notch 20 are in this case formed as a slideway, for instance by means of a milling shaped suitably to impart them a trapezoidal section. The end of this notched portion 19 is terminated by a threaded portion of smaller diameter 21, limited by a shoulder 22.

The tubular second part 16 of the right-angle body comprises a threaded upper part 23 intended for the screwing of a blocking chuck of a lower clamping gripper and a lower portion shaped as a slideway intended to be inserted into the slideway formed by the edges of the notch 20 of the tubular first part 15. This lower portion is in fact shaped precisely like the formed milling cutter used to cut the notch 20, by the juxtaposition of two inverted frustoconical zones 24 and 25 separated by a cylindrical zone 26. This lower portion of the second part 16 of the right-angle body has a flat bearing surface 27 parallel to its axis of revolution.

The threaded plug 17 comprises a smooth portion 28 whose front wall comes against the bearing surface 27 of the second part of the right-angle body, and a hexagonal head 29. This plug 17 has a blind internal thread, not visible, of a diameter and pitch equal to those of the threaded portion 21 of the first part 19 of the right-angle body.

Developed in this manner, the right-angle electric contact plug in accordance with the invention has the advantages of having only three component parts of its outer structure instead of the four of the known right-angle plug, of avoiding in its manufacture the prior assembling of the two parts constituting its right-angle body, and of lending itself completely and easily to the manufacture by cutting and mass production of its three component parts, they being all bodies of revolution.

Upon the connecting of this right-angle plug to an electric conductor, the system assembly of the two parts 15 and 16 of its right-angle body assures, by its locking by means of the plug 17, good tightness due to the resting of the lower slide-shaped portion of the second tubular part 16 in the bottom of the notch 20 of the first part 15 and due to the flat surface 27 which, upon this locking, comes to the level of the shoulder 22 of said first part 15.

Finally, upon the connecting of this right-angle plug to an electric conductor, after the putting in place of the connector and of the electric contact element which have been previously connected, this being effected by sliding the slide of the second part 16 into the slideway of the first part 15 of the right-angle body, the closing of the rear portion of the said right-angle body is effected by mere engagement and locking of the threaded plug 17, without requiring the double operation of positioning a closure element 13 and then screwing a threaded ring 4, as in the case of the known right-angle plug shown in FIG. 1.

It will furthermore be noted that due to the fact that the second part 16 of the right-angle body is removable, the latter has no need of being notched for the introduction of the electrical conductor upon its connection, thus making it possible to eliminate any danger of damage or wedging which might occur in said notch on the known right-angle plug in accordance with FIG. 1 upon the locking of the closure element 3 by means of the threaded ring 4.

Figure 3:
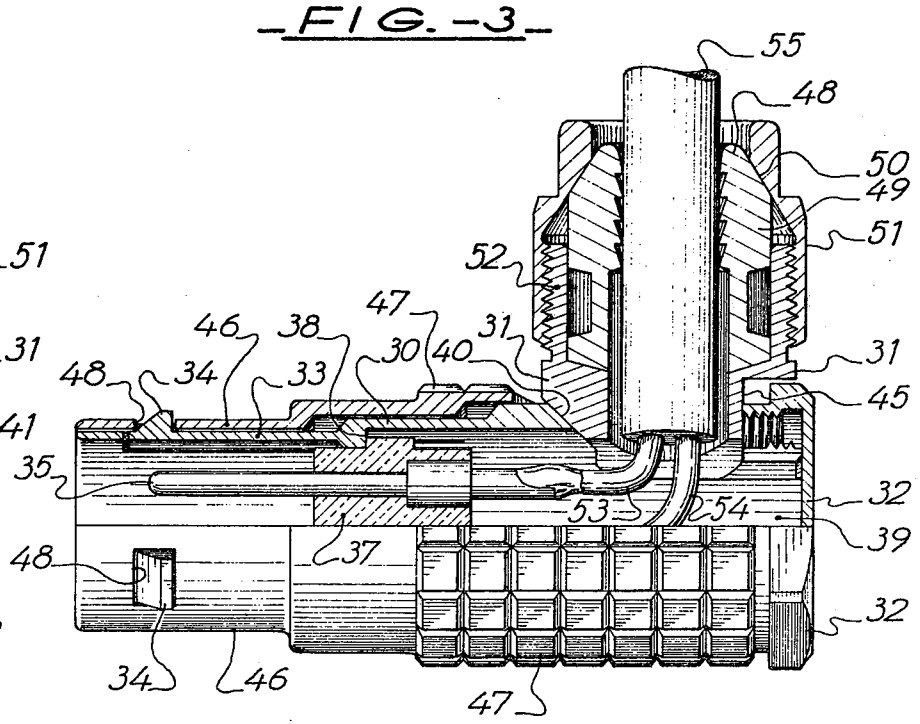
FIG. 3 is a longitudinal semi-sectional half view of the embodiment given by way of example.
Figure 4:
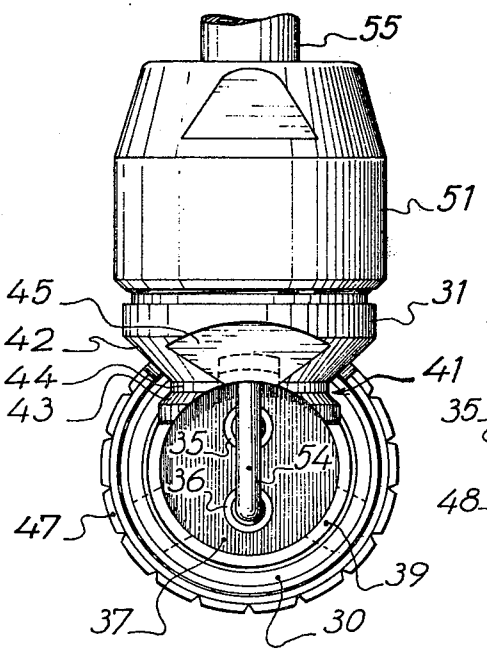
FIG. 4 is a partial right-side view of FIG. 3.

These advantages of the right-angle plug in accordance with the invention extend to all types of electric right-angle plugs made in a manner similar to that described, whether male or female, single pole or multipole, and in particular to automatic locking and unlocking right-angle plugs, one embodiment of which is shown in FIGS. 3 and 4.

The right-angle plug shown is a bipolar male plug whose right-angle body comprises a first tubular part 30, a second tubular part 31, and a closure plug 32 which are similar to those already described and shown in FIG. 2. In the view of FIG. 4, the plug 32 has been removed for the sake of greater clarity.

The first tubular part 30 of the right-angle body of this plug comprises, cut axially in its cylindrical wall, three tongues 33 arranged radially 120° from each other, each having a protruding stop tooth 34. Within this tubular part 30, two contact pins 35 and 36 are held in a cylindrical insulator 37 resting against an inner annular recess 38 of the cylindrical wall of the said first part 30, the said insulator being held by a semi-tubular brace 39, itself resting against the bottom of the plug 32. This first tubular part 30 has a radial notch 40 similar to the notch 20 shown in FIG. 2, the trapezoidal section of the edges of which is clearly visible in FIG. 4, marked 41. Into this radial notch 40 there is inserted the base of the second tubular part 31 of the right-angle body, the geometrical conformation of which, clearly visible also in FIG. 4, is formed by the juxtaposition of two frustoconical zones 42 and 43, separated by a cylindrical zone 44, and by a flat surface 45, as already described and shown also in FIG. 2, but with different reference numbers.

Around the first part 30 of the right-angle body there is slidably mounted, coaxially, a tubular sleeve having a smooth portion 46 intended for plugging in a socket and a knurled part 47 of larger diameter intended for the manipulating thereof. The smooth part 46 has three orifices 48 in which there are engaged the teeth 34 of the tongues 33 of the first part 30 of the right-angle body.

It may be recalled here that this known conformation makes it possible, due to the play of the elastic tongues 33 with stop teeth 34, both to hold the first part 30 of the right-angle body in the sleeve 46–47 and automatically to lock and unlock the plug in a corresponding socket whose cylindrical wall is provided with radial recesses in which the teeth of the tongues 33 engage, this locking and unlocking taking place as a result of the relative axial displacement of the sleeve on the first part 30 of the right-angle body.

The sleeve 46–47 is notched radially at the place of the second part 31 so as not to interfere with the engagement of the latter in the radial notch of the first part 30 of the right-angle body and this radial notch of the sleeve is provided with sufficient longitudinal play to permit its free functional movement.

In the tubular second part 31 of the right-angle body of said plug there is mounted a tubular clamping gripper 48 having radial clamping jaws 49 defined and separated by axial slits (not visible in the drawing) and terminated by a conical portion 50 against which there engages the conical bore of a clamping chuck 51 in the form of a nut in engagement with the threaded upper portion 52 of said second part of the right-angle body. There can be noted here also the two wires 53 and 54 of an electric conductor 55 held in place by the clamping gripper 48 and the connection by soldering of the wire 53 and the rear splayed portion of the pin 35, the other wire 54 being connected in the same manner to the other pin 36.

Produced in this manner, this right-angle socket with automatic locking and unlocking enjoys the aforementioned advantages of the right-angle plug in accordance with FIG. 2, both by its simple structure and by the reliability of its system of assembly and disassembly.

Changes may be made, in particular in the development of the slideway slot of the tubular first part and the slideway-shaped base of the tubular second part of the right-angle body; these two elements may be shaped differently in their geometry, for instance not based on a trapezoidal section of the edges of the notch but, for instance, on a triangular, square or round section, and their development may be adapted to each of the forms selected. Similarly, the flat surface 45 of the base of the second part 31 of the right-angle body, on which the smooth portion of the threaded plug 32 rests, is not indispensable and a similar effect can be obtained, for instance, by beveling said smooth part of the threaded plug 32 along an angle corresponding to the slope of the conical zone 42 of the base of the second portion 31 of the right-angle body.

However, these geometrical forms of the assembly of the two parts of the right-angle body which have been given as example are preferable since they assure, in simple and rational manner, good tightness and at the same time a firm hold of these two parts.

What is claimed is:

1. Right-angle electric contact plug whose right-angle body comprises a first tubular part comprising at least one removable electric contact element and a radial end notch, a second tubular part opening into the radial notch of the first part and having a clamping gripper intended to hold an electric connecting conductor, and a removable closure element fastened on at least one of the two parts of the right-angle body and intended to close the notched end of the first part of said right-angle body after connection of the electric conductor with the electric contact element, characterized by the fact that the two parts of the body are removable, by the fact that the two edges of the radial notch of the first part of the body are shaped as a slideway, by the fact that the base of the second portion of the body is shaped as a slide, by the fact that the notched end of the first part of the body is threaded, and by the fact that the closure element of the said notched end is a threaded plug, so that after connection of the electric conductor with the electric contact element, said contact element is introduced into the first part of the body at the same time as the slide of the second part of the body is engaged in the slideway of the notch of the first part, and by the fact that finally the threaded closure plug is screwed and clamped on the threaded end of said first part, thus rigidly assembling the two parts of the body by locking the slide of the second part against the bottom of the slideway of the notch of the first part.

2. Right-angle plug according to the claim 1 characterized by the fact that the section of the edges of the notch of the first tubular part of the right-angle boby is trapezoidal and by the fact that the base of the second tubular part of the right-angle body has two inverted frustoconical zones separated by a cylindrical zone, the cross section of the assembly of these three zones being adjusted to the said trapezoidal section.

3. Right-angle plug according to claim 1 characterized by the fact that the base of the second tubular part of the right-angle body comprises a flat resting surface intended to bear against the front wall of the threaded plug.

* * * * *